US006279864B1

(12) United States Patent
Carnahan et al.

(10) Patent No.: US 6,279,864 B1
(45) Date of Patent: Aug. 28, 2001

(54) SEAT ASSEMBLY

(76) Inventors: Garnett Carnahan; Caroline Carnahan, both of P.O. Box 1407 - Sale Barn Rd., Nixa, MO (US) 65714

( * ) Notice: Subject to any disclaimer, the term of this patent is extended or adjusted under 35 U.S.C. 154(b) by 0 days.

(21) Appl. No.: 09/127,848

(22) Filed: Aug. 3, 1998

(30) Foreign Application Priority Data

Nov. 12, 1997 (CN) ..... 97 2 42624

(51) Int. Cl.[7] ..... F16M 13/00
(52) U.S. Cl. ..... 248/418; 248/415; 297/344.19
(58) Field of Search ..... 248/158, 404, 248/418, 222.11, 503.1; 297/344.19, 344.22; 403/109.1, 109.7, 110, 109.8; 114/363

(56) References Cited

U.S. PATENT DOCUMENTS

| | | | | |
|---|---|---|---|---|
| 3,711,054 | * | 1/1973 | Bauer | 248/562 |
| 4,183,689 | * | 1/1980 | Wirges et al. | 403/31 |
| 4,673,155 | * | 6/1987 | Binder | 248/404 |
| 4,979,718 | * | 12/1990 | Bauer et al. | 248/631 |
| 5,702,083 | * | 12/1997 | Lai | 248/404 |
| 5,740,997 | * | 4/1998 | Van Wieran | 248/404 |
| 5,882,076 | * | 3/1999 | Garelick et al. | 297/344.18 |
| 6,022,077 | * | 2/2000 | Kirkland et al. | 297/344.19 |
| 6,199,806 | * | 3/2001 | Sauer et al. | 248/161 |
| 6,199,952 | * | 3/2001 | Davis | 297/344.19 |

OTHER PUBLICATIONS

The Springfield Marine Company, Springfield 1998–99 Marine Products Catalog.*
The Springfield Marine Company, Springfield 1996 Marine Products Catalog.*
The Springfield Marine Company, Springfield 1995 Marine Products Catalog.*

* cited by examiner

*Primary Examiner*—Anita M. King
*Assistant Examiner*—N. Morrison
(74) *Attorney, Agent, or Firm*—Smith Gambrell & Russell, LLP

(57) ABSTRACT

A seat assembly featuring a seat support assembly having a seat mount assembly and a pedestal post assembly which pivotally supports the seat mount assembly and includes a first component and a second component with the second component being adjustable in height with respect to the first component. The seat support assembly includes a rotation locking assembly with a releasable rotation lock which locks the seat mount assembly from rotating with respect to the pedestal post assembly. Also included is a rotation prevention device or arrangement that is supported by the pedestal post assembly and acts to prevent relative rotation between the first and second components while not interfering with height adjustability between the first and second components. In a preferred embodiment, the first and second components are part of a fluid spring system which has an air spring that varies in height by way of a fluid cushion. Preferably, the air spring system includes an inner cylinder with a plurality of externally positioned, elongated projections spaced about the inner cylinder so as to define a plurality of grooves between the projections, and the rotation prevention device further includes a bushing with corresponding grooves and projections that is fixed to an outer cylinder component of the air spring system. The invention also features a method for forming a pedestal post assembly which includes press fitting an extruded sleeve with a circumferential series of projection/recess combinations about the main body of an inner cylinder.

18 Claims, 12 Drawing Sheets

SEAT ASSEMBLY

FIELD OF THE INVENTION

The present invention relates to a seat assembly, and particularly a seat support assembly, that is well-suited for seating assemblies such as boat swivel seating assemblies.

BACKGROUND OF THE INVENTION

The American Boat & Yacht Council, Inc. of Connecticut (US) published in 1994 a set of standards for which voluntary compliance has been recommended for boat products constructed after Sep. 1, 1996. Within these standards, under section H-31, there is provided recommended seat structure standards and tests for determining whether those standards are met with a particular design.

These standards set out in the 1994 publication include the following definitions:

Adjustable Seat—a permanently installed seat designed to allow the occupant to adjust the seat position vertically and/or horizontally (fore and aft and/or laterally).

Locking Mechanism—a mechanism designed to resist fore and aft, lateral, vertical and rotational movement of the seat.

Permanently Installed—seats whose base or attaching system is permanently attached to the hull or a hull structure. Seats that are readily removable from a permanently installed base or attaching system are considered permanently installed.

Positive Locking Mechanism—a mechanism which relies on mechanical interference or the use of gas springs to prevent fore or aft, lateral, vertical and rotational movement of the seat.

NOTE: Friction devices are not considered mechanical interference locks.

Positive Locking Swivel—relies on positive mechanical inference, not friction, to lock the seat in position.

Readily Removable—capable of removal without the use of tools.

Swivel Seat—a seat designed to rotate about a vertical axis.

Type A Seat—a seat designed for occupancy while the vessel is underway at any boat speed.

Type B Seat—a seat designed for occupancy only at boat speeds not exceeding five miles per hour.

These standards also provide guidelines that are based on whether the seat is a type A (passenger) seat, a type A (operator's) seat or a type B seat. The guidelines include the following:

(1) H-31-.7: Type A adjustable seats.

(2) H-31-.7.1: All type A adjustable seats shall employ a locking mechanism for each plane or axis of movement.

(3) H-31-.7.3: Seat swivel locking mechanisms, when locked, shall not rotate relative to the seat base when subjected to a torque of 30 foot pounds (41 N·m).

(4) H-31-.7.4: Seats with a vertical adjustable feature shall have a positive locking mechanism. (emphasis added)

(5) H-31.7.6: Operator's Swivel Seats with a vertical adjustment feature shall have a positive locking mechanism.

(6) H-31.7.6.1: All operator's seats shall have positive locking swivels that permit the seat to be locked in the intended position and capable of withstanding 150 foot pounds (205 N·m) of torque.

(7) 31.7.6.2: All seats interchangeable with the operator's seat must meet the requirements of this section.

The ABYC standards can also be summarized as follows with respect to torsion strength requirements.

(1) Type A (Operator)—(Swivel seat capable of withstanding 150 ft-lbs (205 N·m) of torque).

(2) Type A (passenger)—(Swivel seat capable of withstanding 30 ft-lbs (41 N·m) of torque).

(3) Type B (seats designed for boats not to exceed 5 mph)—(no standard provided seat can freely rotate due to low speed).

There exists in the prior art an air adjustable "Power Rise"™ seat assembly which is available from Springfield Marine Company of Nixa, Mo. The "Power Rise"™ air spring system features a swivel seat mount that is supported on a stem which is inserted within a cylindrical post and has a hollow cavity for receiving a piston and piston stem with the latter being free to rotate, but fixed axially with respect to the post. The stem includes a spring biased valve at its top positioned within the swivel seat mount. Upon depressing the valve with a shifting lever, the seat can be shifted vertically down or raised to the desired level (under the power of compressed air) where, upon the operator returning the shifting lever to a valve closed position, the spring seat is locked at the desired height.

Based on the above guidelines, a positive locking mechanism can be represented by a gas spring such as the "Power Rise"™ adjustable vertical height gas spring discussed above. Accordingly, with respect to vertical axis movement, the "Power Rise"™ air spring system satisfies the above quoted guideline "H-3-7.4" for Type A adjustable (passenger) seats as the air spring is considered a positive locking mechanism for vertical movement. However, because the "Power Rise"™ air spring system freely rotates, it is not in conformance with the recommended guideline H-31-.7-.1 which requires a locking mechanism for each plane or axis of movement. Thus, the "Power Rise"™ spring systems are primarily designed for use in Type B settings. Further, any rotational locking mechanism, to be sufficient for Type A (passenger) seats is required to satisfy the recommended guideline of H-31-.7.3 requiring torque resistance of 30 ft-lbs (41 N·m).

In co-pending application Ser. No. 08/682,189 to Mike Mawhiney, filed on Jul. 17, 1996, there is described a rotation locking assembly which utilizes a cam-activated friction clamp to lock by friction the telescoping inner cylinder of a Power Rise™ seat assembly. This friction clamp is sufficient to satisfy the 30 foot-pounds or (41 N·m) standard set out in H-31-.7.3. The system in application Ser. No. 08/682,189 therefore makes possible the use of a vertical air spring system for Type A adjustable seats and thus allowed for the first time the use of a Power Rise™ seat assembly other than in a Type B seat assembly.

However, the seat assembly system described in application Ser. No. 08/682,189, because it relies on a friction lock and also because that friction lock is not specifically designed to withstand 150 foot-pounds (205 N·m), is not intended to provide a seat assembly support system that satisfies H-31.7.6.1 under the operator's swivel seat heading. Accordingly, due to H-31.7.6.2, which requires all seats to satisfy the operator's seat standard when an interchangeable operator's seat is involved, the operator's seat had to be non-interchangeable with respect to the Type A adjustable passenger seats.

Furthermore, while the friction lock mechanism in application Ser. No. 08/682,189 is in a locked state, to prevent rotation during +5 mph travel, the telescoping inner cylinder is vertically locked with respect to the other cylinder so as to lose the benefits of an air cushion ride made possible by an air spring system. That is, the aforementioned Power Rise™ system, in addition to allowing vertical adjustment through manipulation of a lever, also provides a one to two inch cushion effect due to compression of the fluid held by the inner cylinder when the valve is locked. The fact that the friction lock in application Ser. No. 08/682,189 is applied for travel in excess of 5 mph, means that the cushion ride advantage made possible by an air spring is non-operational at a time when most needed (i.e., higher speed travel).

SUMMARY OF THE INVENTION

The present invention, among other things, is directed at providing a seat system or assembly that features a seat support assembly satisfying the rotation locking standards for both Type A (passenger) and Type A (operator) seats such that a non-operator's seat can be made interchangeable with an operator's seat. With this interchange possibility, there is only one form of seat support assembly required as that one form is capable of functioning both as an operator's seat and as a passenger seat (rearward positioned fishing seat). This provides a more economical use of equipment and prevents the problem of a person installing a non-recommended seat in the operator's position. [Further, the present invention is directed at providing a locking function that, in addition to meeting the higher level rotation prevention locking requirement standard for a Type A (operator) seat support assembly, allows for operation of an air spring system at all times so as to provide a cushion ride even when the system is in a rotation lock state and even vertical height adjustment while the seat assembly is in a rotation lock state, if such is desired.] Thus, both the passenger and operator can enjoy the benefits of a fluid cushion ride during movement of the vessel, as well as height adjustment versatility.

The present invention also provides a seat support assembly that[has a rotation lock assembly] which is easily positioned in either a locked/non-rotation state or an unlocked/free rotation state. Also, the seat support assembly, when including an air spring support assembly, provides air spring and rotation adjustment levers in a readily accessible position between the operators legs so as to minimize space requirements for the assembled seat system.

The design of the present invention also makes for a highly durable and easy to manipulate seat support assembly which additionally makes possible the use of materials such as an all plastic seat mount.

The advantageous present invention features a seat support assembly that comprises a seat mount assembly and a pedestal post assembly that pivotally supports said seat mount assembly and includes a first component and a second pedestal post component with the second component being adjustable in height with respect to the first component. There is further included a rotation locking assembly that includes a releasable rotation lock which locks said seat mount assembly from rotating with respect to said pedestal post assembly. A rotation prevention device is further included and is supported by said pedestal post assembly so as to prevent relative rotation between said first and second components while not interfering with height adjustability between said first and second components. The pedestal post assembly preferably includes a fluid spring system that involves said first and second components with an upper component being variable in height due to a fluid cushion provided by said fluid spring system.

In a preferred embodiment, said first component is an outer cylinder for a fluid (e.g., air) spring system and said second component is a fluid (e.g., air) spring inner cylinder telescopically received by said outer cylinder and said rotation prevention device includes at least one elongated projection extending along at least one of said inner cylinder and outer cylinder. In one embodiment, the inner cylinder includes a plurality of externally positioned, elongated projections spaced about a main body of said inner cylinder so as to define a plurality of grooves between said projections, and said rotation prevention device further comprises a blocking member having a series of ridges and grooves and is supported by said outer cylinder so as to be in engagement with said projections and grooves of said inner cylinder to prevent relative rotation between said inner and outer cylinders. The ridges and grooves of the blocking member is preferably provided by a bushing member secured to said outer cylinder or an integral extension of the outer cylinder. Preferably, said elongated projections and grooves of the inner cylinder are defined by an extruded sleeve which is in non-rotation engagement with an outer surface of a main body of said inner cylinder. The term "cylinder" is being used in a broad sense in this application to mean an elongated fluid containment device and is not meant to be particularly limited to a cylindrical casing shape.

The pedestal post assembly further comprises an end cap pivotally supported on an upper end of said second component or inner cylinder. The end cap has means for engaging with said releasable rotation lock of said rotation locking assembly such as a slot or depression formed in the end cap so as to allow the inserted rotation lock to prevent rotation of said seat mount with respect to said end cap. The end cap also includes at least one protrusion which is receivable within one of said grooves formed between the projections of the inner cylinder so as to prevent relative rotation between said end cap and inner cylinder. The end cap preferably includes a plurality of circumferentially spaced protrusions which converge from a radial thickness standpoint in going from a top area of said cap to a more lower region of said end cap. Thus, in a preferred embodiment of the invention, said pedestal post assembly includes an end cap which is positioned on said second component and the end cap is received within a recess formed in a seat mount of said seat mount assembly such that said seat mount is free to rotate with respect to said end cap when said releasable rotation locking assembly is in a non-locking state. Accordingly, the end cap has both means for engaging (e.g., receiving) said releasable rotation lock and means for engaging (end cap protrusions) said second component (e.g., inner air spring) in a non-rotation fashion.

The pedestal post assembly further comprises a base attachment assembly positioned on an end of said pedestal post assembly opposite to said end cap, and said pedestal post assembly has means for preventing rotation of said pedestal post assembly with respect to a base to which said base attachment assembly is attached. A base can be a device that is either integral or secured to a more fixed structure such as a deck of a boat and which is designed to receive the end of the pedestal post of the pedestal post assembly to, for example, releasably hold the post in place. In a preferred embodiment, the base end of the pedestal post has an inwardly deformed projection designed to receive an outwardly extending object formed in a cup-shaped reception section of the base. Various other arrangements are also contemplated which achieve the desired functional objectives.

The present invention is particularly useful in a system wherein said inner air spring cylinder has a height adjustment mechanism and said seat mount assembly includes means for triggering said height adjustment assembly. Examples of this type of height adjustment pedestals which are used in other settings than that of the present invention, can be found in the "Power Rise"™ pedestal systems of Springfield Marine Company of Nixa, Mo. Under this preferred embodiment of the present invention, the means for triggering includes a first operator contact device and said releasable rotation locking assembly includes a second operator contact device supported by said seat mount assembly, and said first and second operator contact devices both extend out from a common side of said seat mount (e.g., within less than 20° from each other) and said common side represents a front section of said seat mount when in seat support position.

The present invention also preferably features a seat mount that has an interior wall defining a reception cavity which represents said recess for receiving said end cap and an outer wall extending away from a common, lower connection with said inner wall in an outwardly oblique fashion so as to define an annular cavity between said inner and outer walls, and said rotation locking assembly includes a block of material representing said releasable rotation lock and having an extension insertable through a hole in said inner wall for contact with said engaging means of said end cap, a biasing member for biasing said block into a locking state and a handle representing said second operator contact device which extends through an opening formed in said outer wall. Preferably, the seat support assembly features a seat mount that is entirely formed of plastic as opposed to a metal material or a combination of metal and plastic.

The present invention is directed also at a seat assembly having a pedestal post assembly with an upper section and a lower section, and means for providing a relative adjustment in height between the upper end of said upper section and said lower section, as well as a seat mount assembly which is pivotally supported on the upper end section of said pedestal post assembly. A locking mechanism for releasably locking in non-rotation fashion said seat mount on said upper end section is also provided together with means for precluding rotation between said upper section and said lower section while not interfering in the freedom of relative height changes between said upper section and lower section. (The term "seat assembly" as used herein can be in reference to the support assembly for a seat unit alone (with or without a base member) or the support assembly in combination with a seat unit.)

Further, base attachment means is provided at a lower end of said lower section for attachment with a base member so as to preclude both vertical separation and rotation of said lower section with respect to said base member. The noted upper section preferably includes a first fluid spring unit and said lower section includes a second fluid spring unit and said means for providing relative adjustment in height has a compressible fluid cushion formed between said first and second fluid spring units. Also, in a preferred embodiment, the first and second fluid spring units are telescoping air springs and said means for precluding rotation includes a plurality of elongated interlocking projections and grooves provided between said first and second fluid spring units.

The present invention is also directed at a method of forming a seat support assembly which includes the steps of providing a seat mount assembly, providing a pedestal post assembly which has a first end that pivotally supports said seat mount assembly and also first and second height adjustment components. The method further including providing a releasable rotation locking member for locking said seat mount assembly from rotating with respect to said pedestal post assembly, and providing the pedestal post assembly with a rotation precluding member which is designed to preclude rotation of said first and second height adjustment components while allowing free vertical adjustment therebetween. The method of the present invention also preferably features press fitting a sleeve with projections and grooves over one of said first and second height adjustment components (preferably the height adjustment component with the sleeve is a telescoping, inner air spring component having the extruded, press fit, sleeve formed over a main body of the air spring cylinder).

BRIEF DESCRIPTION OF THE DRAWINGS

The advantageous aspects of the invention will be more fully appreciated from the following description, particularly when consideration is given in conjunction with the attached drawings, wherein.

DETAILED DESCRIPTION OF THE DRAWINGS

Figure 1:
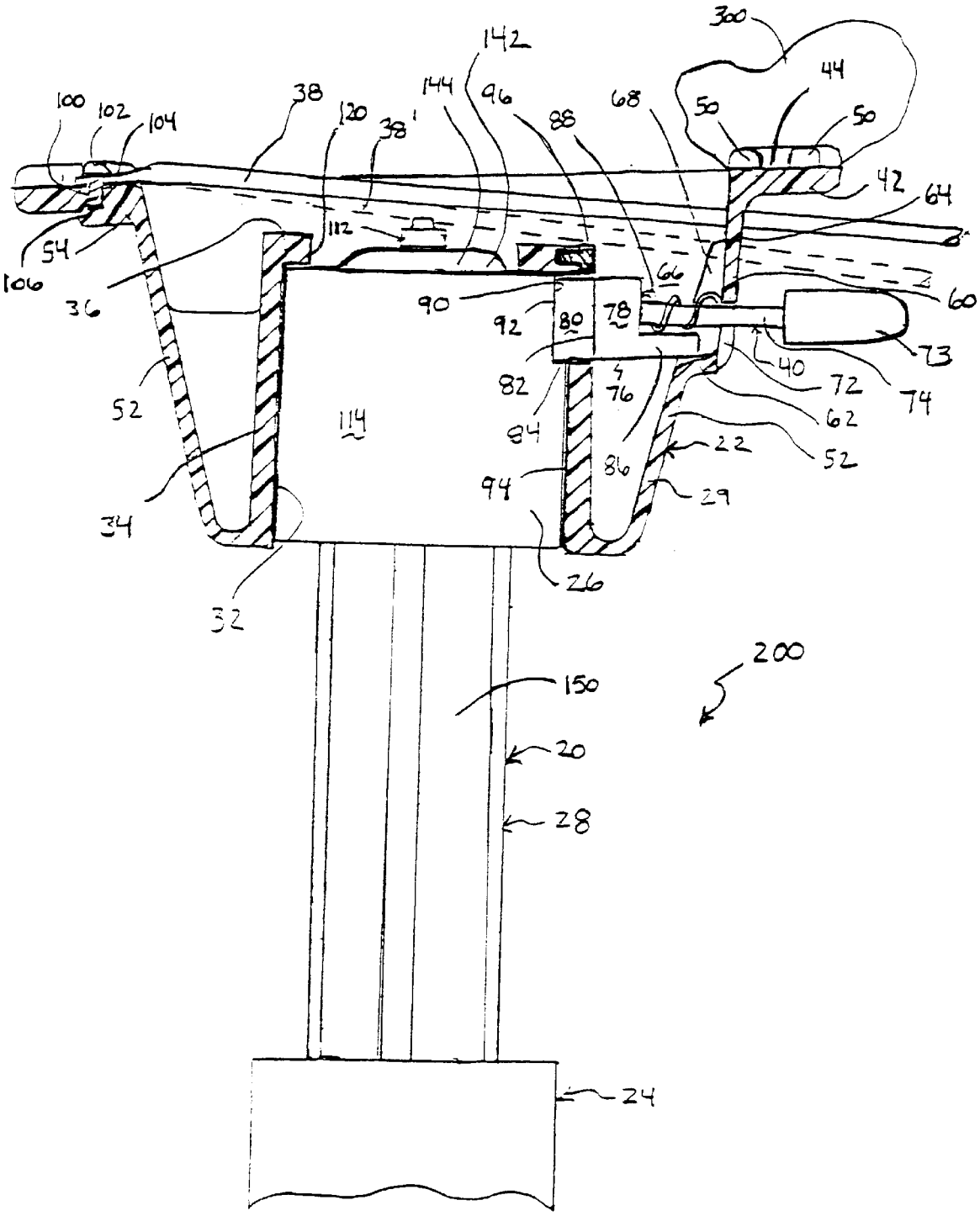
FIG. 1 shows a cut-away and cross-sectional view of a preferred embodiment of the seat support assembly of the present invention.
Figure 2:
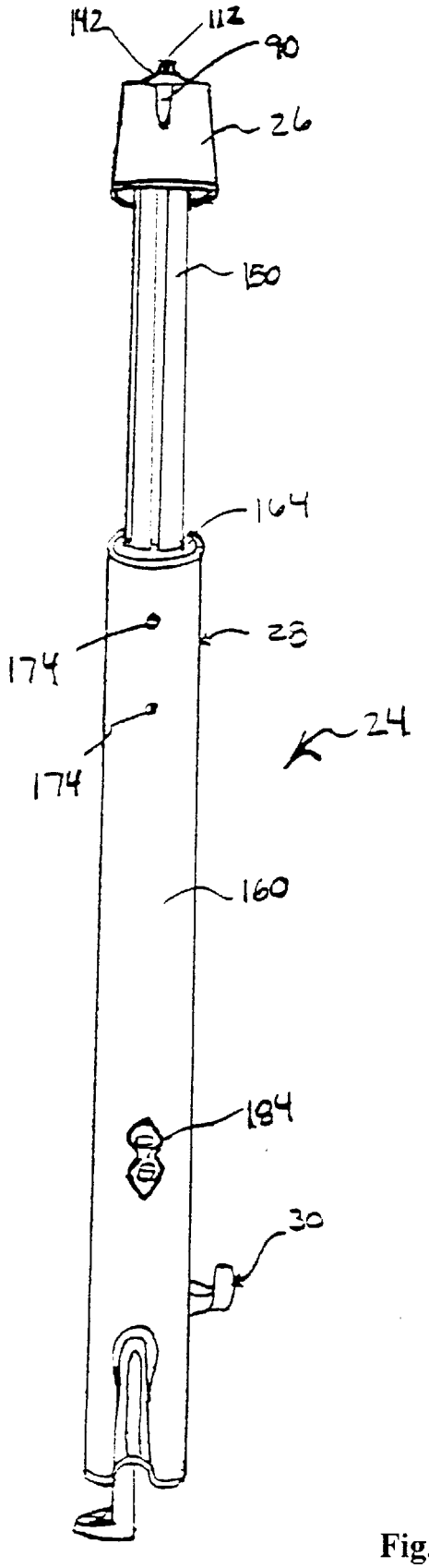
FIG. 2 shows an elevational view of the post assembly of the present invention.

FIG. 1 shows, both in cut-away and in cross-section, a preferred embodiment of seat assembly 200 of the present invention which includes seat support assembly 20 and also seat unit 300 (a general section of which is shown in FIG. 1 and can take any conventional form such as a molded plastic seat shell or a more complex foam pad seat unit). Seat support assembly 20 includes seat mount assembly 22 which is supported by pedestal post assembly 24 which is shown in its entirety in FIG. 2. As shown in FIGS. 1 and 2, pedestal post assembly 24 comprises upper end cap 26, fluid (air) spring assembly 28 and base attachment assembly 30.

As further shown in FIG. 1, seat mount assembly 22 includes seat mount 29 having end cap reception cavity 32 defined by interior wall 34 and inwardly extending annular flange 36. Interior wall 34 slightly converges in going from bottom to top and is dimensioned to essentially conform with the exterior surface of end cap 26 so as to provide a snug reception while allowing for freedom of rotation of seat mount 29 with respect to end cap 26 as described in greater detail below.

With reference to FIGS. 1 and 3–6, in particular, a description of seat mount assembly 22 is provided. Seat mount assembly 22 includes seat mount 29, vertical adjustment handle 38 and rotation locking assembly 40. In addition to the above noted interior wall 34 and flange 36, seat mount 29 features exterior mount member 42. Exterior mount member 42 features a generally planar upper surface 44 off from which extends thickened mount portions 46 each having a central, elongated through-slot 48. In addition, upwardly extending from surface 44 are a plurality of protrusions 50 which, in the preferred embodiment, are two pairs of side by side protrusions with each pair falling on a common line spaced just off-center from a central bisecting line, which is parallel to the common line of protrusion alignment.

The slots 48 in thickened mount portions 46 are designed to receive an appropriate fastener for securely joining seat mount 29 to the undersurface of a supported seat, particularly a boat seat (not shown) for which the present invention is particularly well-suited for supporting, while allowing for rapid and easy vertical and rotational adjustment and yet still allowing for a cushioning effect when in a rotation lock mode, as explained in greater detail below. The elongated slots allow for easy attachment of a seat or the like to the seat mount by providing some flexibility in placement of the fastener means component of the seat with respect to the seat mount assembly 22. The projections 50 can help in relative location of the seat with the seat mount. In the illustrated embodiment of the present invention, exterior mount member has a four-sided periphery with the slotted mount protrusions provided in the corners with their slots elongated in the radial direction. Any variety of shapes in mount member 42 and positions of the fastener slots 48 are possible, however, so long as a proper supporting connection is provided between mount member 42 and the seat to be fixed to seat mount assembly 22.

With reference to FIGS. 1, 4, 5 and 6 in particular, seat mount 29 includes mainly frusto-conical shaped, outer wall 52 that slopes downwardly and inwardly from an interior edge 54 of exterior mount member 42. The slope of outer wall 52 is designated by angle A1 and preferably has ranges of 5 to 30°, more preferably a range of 10–18° with the preferred slope being 14°. Between outer wall 52 and interior wall 34, there is formed converging recess 56 which extends completely around outer wall 52, except for ribs 58. As shown particularly in FIG. 4, there are four ribs 58 in the preferred embodiment which are equal in number and radially aligned with the direction of elongation of slots 48.

Figure 3:
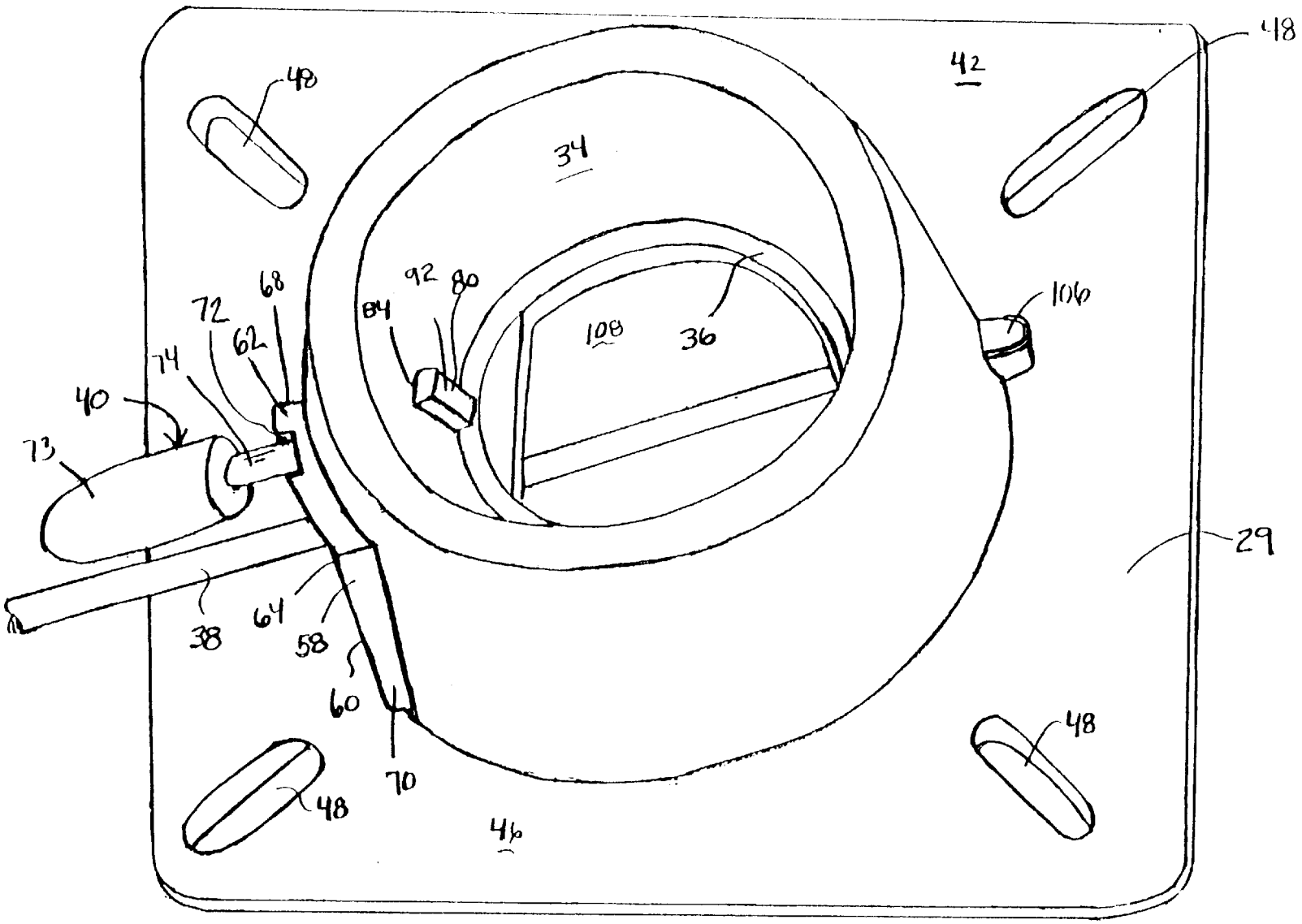
FIG. 3 shows a perspective view of the bottom of the seat mount shown in FIG. 1.
Figure 4:
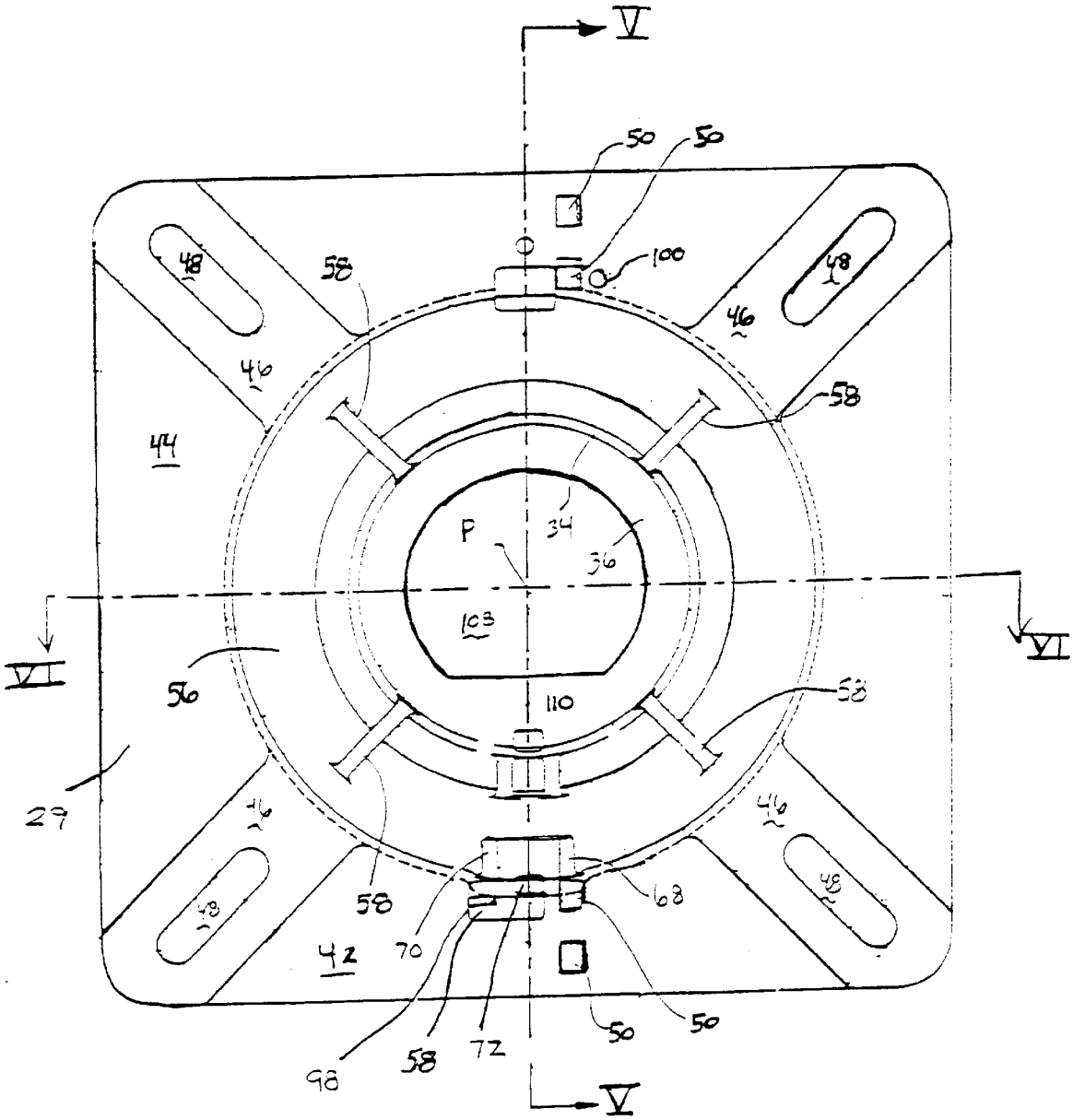
FIG. 4 shows a top plan view of the seat mount in FIG. 1.

With reference to FIGS. 1, 3 and 4, seat mount 29 includes shoulder section 60 located circumferentially midway between two of ribs 58. Shoulder section 60 includes shoulder 62 which extends radially out from sloped outer wall 52, as well as two side walls 68, 70 defined by non-interrupted portions of outer wall 52. Shoulder section 60 further comprises essentially vertically oriented wall section 64 which extends into interior edge 54 of exterior mount member 42. Shoulder section 60 thus defines shoulder section recess 66. At the intersection of shoulder 62 and wall section 64, there is also formed lower slot 72.

As shown in FIG. 1, rotation locking assembly 40 includes handle grip 73 attached to stem 74 which extends through lower slot 72. The interior end of stem 74 is secured to radial locking block 76. Radial locking block 76 includes outer L-shaped section 78 and interior insertion component 80. Interior insertion component 80 has less of a thickness than L-shaped section 78 and is centered with respect to the same such that shoulders 82 are formed. Through-hole 84 is formed in wall 34 and is sized to snugly receive insertion component 80 such that shoulders 82 abut the exterior surface of outer wall 52 when in the inward or locking position shown in FIG. 1. Lower leg component 86 of block 76 extends radially out from insertion component a sufficient distance so as to rest on shoulder 62. Spring 88 is wrapped abut stem 74 and has an interior end abutting block 76 and an outer end abutting vertical wall section 64 so as to bias locking block 76 inward into cap slot 90 (FIG. 2) formed in cap 26. Upon pulling radially out on grip 73, block 76 shifts radially outward a sufficient distance to position interior edge 92 of block 76 in line with interior surface 94 of end cap reception cavity such that seat mount 29 is free to rotate with respect to end cap 26. FIG. 1 further illustrates lock screw 96 received in a slotted section formed in the outer periphery of flange 36 to lock into position block 76 after initial insertion. Stem 74 is preferably received by block 76 in threaded fashion to facilitate initial insertion of spring 88 and block 76 into position.

An upper, elongated slot 98 (FIGS. 4 and 6) is also formed in vertical wall section 64 (in an upper, opposite corner of wall section 64 as compared with lower slot 72) and vertical adjustment handle 38 extends through the elongated, upper slot 98. At a location diametrically opposed from upper slot 98, there is provided fastener hole 100. As shown in FIG. 1, fastener 102 extends through an aperture formed in flattened section 104 of vertical adjustment handle 38 and into fastener hole 100 formed in thickened tab section 106. The fixed in position adjustment handle 38 extends across radial center point P of wall 34 as shown in FIG. 4. As also shown in FIG. 4, flange 36 defines a generally D-shaped opening 108 in that flange 36 has thickened section 110 in the region where insertion hole 84 is formed in interior wall 34.

As shown in FIG. 1, vertical adjustment handle extends immediately above air valve stem 112 of air spring assembly 28 while in an unflexed state. As shown by dashed lines in FIG. 1, handle 38 can be vertically shifted by flexing handle 38 downward within upper, elongated slot 98 until handle 38 achieves position 38' wherein air valve stem 112 is shifted down to provide for air release and vertical adjustment of seat mount 29 as explained in greater detail below. Once the operator releases handle 38, it naturally flexes back (mainly at the pivot junction formed by flattened section 104 and fastener 102) into a non-engagement state with respect to valve 112. Various other valves and valve triggering mechanisms can also be used to achieve the air release, although the illustrated arrangement is preferred for easy access and activation.

Figure 5:
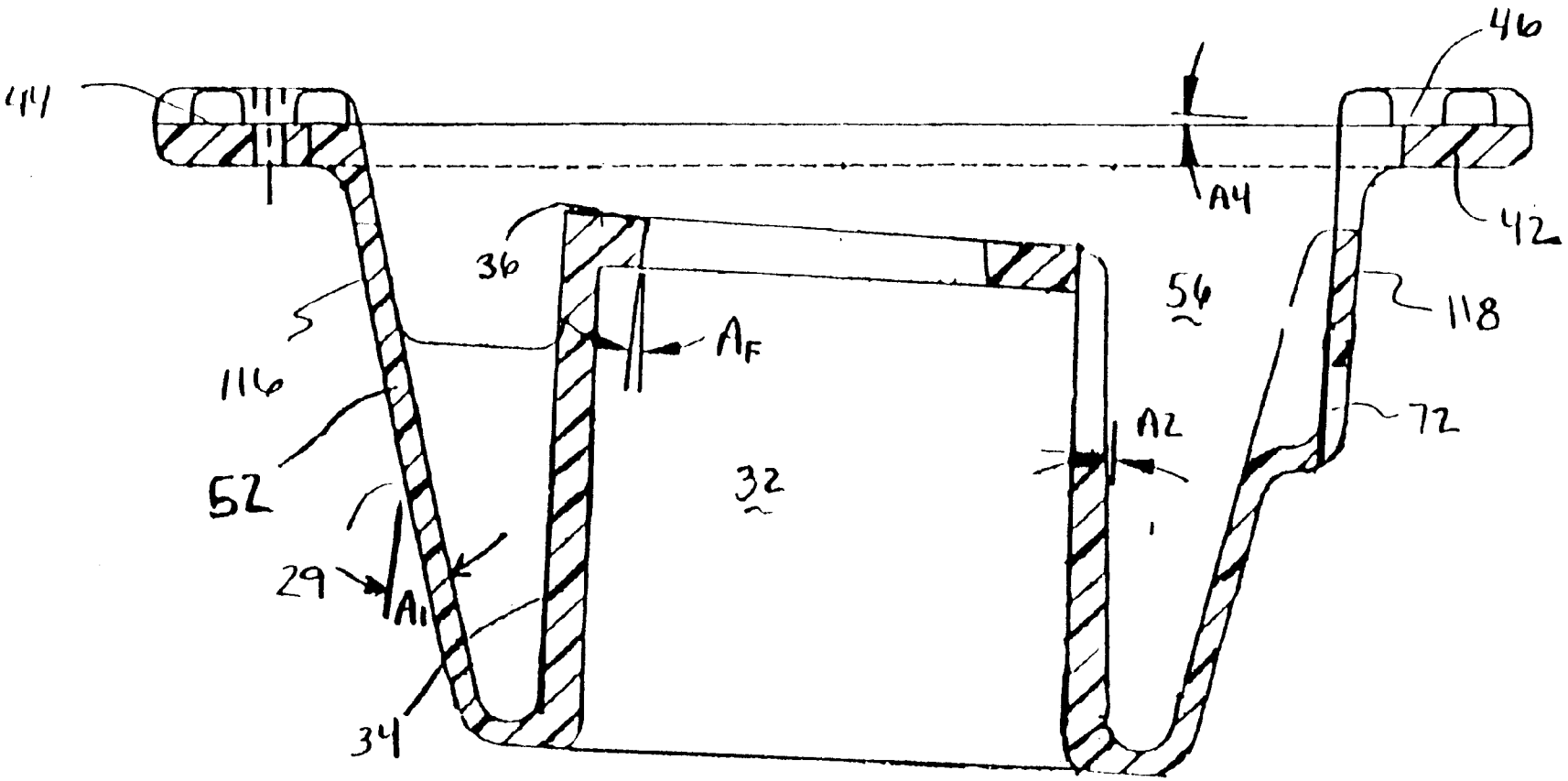
FIG. 5 shows a cross-sectional view taken along cross-section line V—V in FIG. 4.
Figure 6:
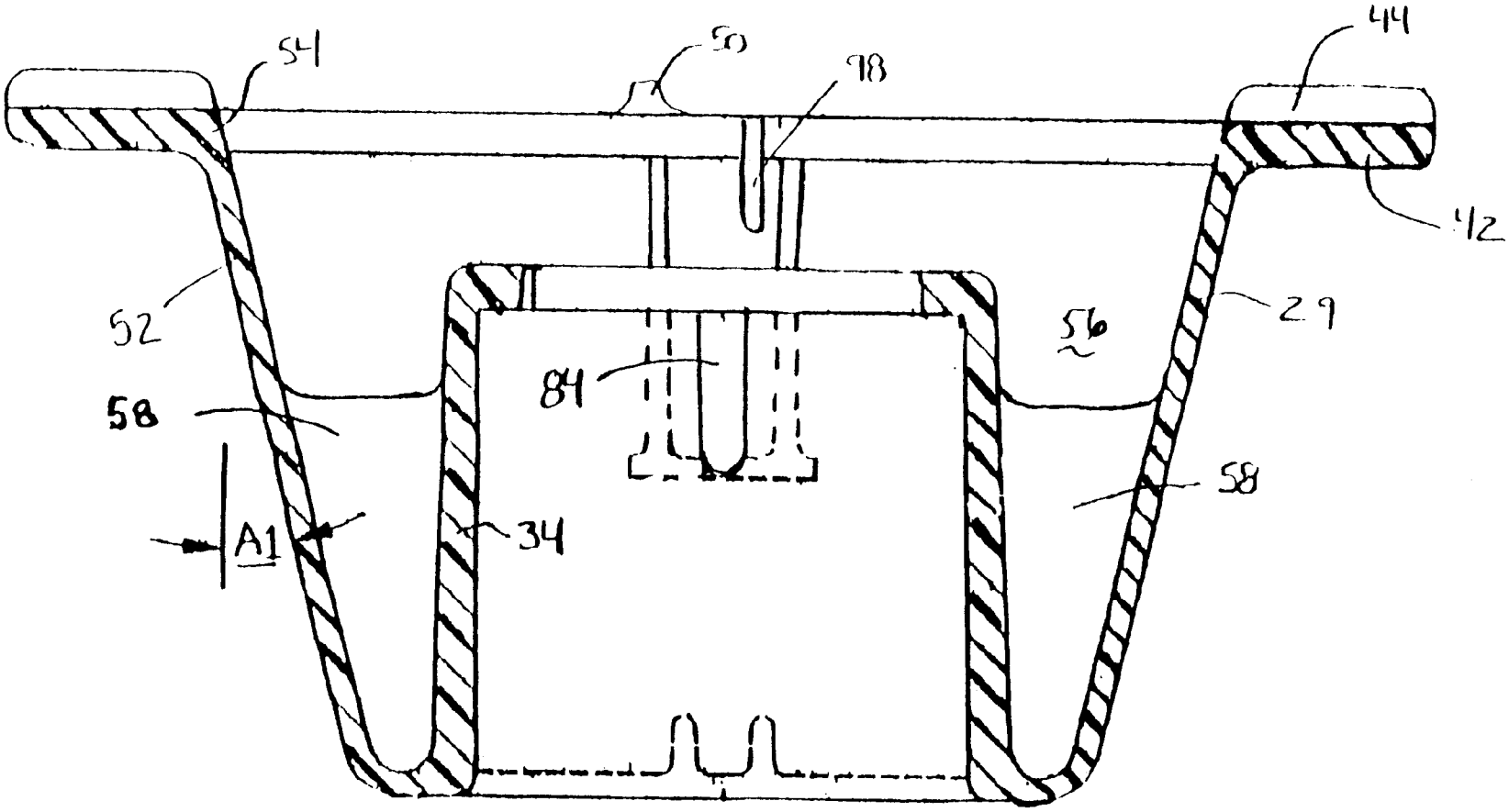
FIG. 6 shows a cross-sectional view taken along cross-section line VI—VI in FIG. 4.

FIG. 1 also illustrates the engagement of cap 26 within end cap reception cavity 32 of the seat mount assembly. As shown in FIG. 5, for example, the interior wall 32, which defines cavity 32, slopes inward by an angle A2 (FIG. 5) which is preferably a slight angle of 0–5° and, more preferably, 2°. Outer surface 114 of end cap 26 preferably also has a slight taper (e.g., angle 0–5°) as represented by A3 in FIG. 10 and in a preferred embodiment, that taper is less than that of wall 34 by a degree or two (e.g., 1° end cap taper versus 2° wall 34 taper). In this way, a snug friction engagement is provided which still provides for relatively easy rotation. This can be compared with outer wall 52 of seat mount 29 which preferably has a 14° slope while wall section 64 with the reception slots 72 and 98 formed therein preferably has a slope of 0–5° and more preferably 2°.

As shown in FIG. 5, planar surface 44 of seat mount 29 preferably rises slightly at angle A4 (e.g., 1–5° slope and more preferably a 3° slope) in going from back end 116 to front end 118. Thus, when a seat is secured to seat mount 29, there is provided a slight tilt back effect which is desirable for many situations such as a boat seat situation.

As end 118 represents the front end of seat mount 29, it can be seen that both handle 38 and handle grip 73 are provided at the front end of seat mount slightly offset from a circumferential standpoint (e.g., 10 to 30° and more preferably 15 to 20°) and thus are both readily accessible between the legs of the operator while sitting. Furthermore, this arrangement takes advantage of positioning as there is always leg room in front of the seat, but side room often makes manipulation difficult, particularly in a boat environment wherein the side wall of the boat adjacent a seat may make access particularly problematic. Under the preferred arrangement of the present invention, the operator need only push down on handle 38 extending through and out away from the front of the seat mount to provide for vertical adjustment through, for example, release of air in air spring assembly 28 and/or pull out handle grips 73, to release lock projection 80 and to allow seat mount 29 to be rotated by the operator into a desired position (e.g., a desired fishing orientation). If it is desired to prevent rotation of the seat attached to the seat mount during boat travel, for example, the operator need merely bring the chair into a forward orientation, wherein the spring biased locking block automatically snaps into a locking position. In addition, since handle 38 extends across the central point P of wall 34, handle 38 is always positioned directly above valve stem 112 regardless of the particular rotation position of the seat. Also, unlike the prior art embodiments, this vertical adjustment is possible whether the seat mount is in a free to rotate position or in a fixed from rotation position or state.

Another advantage of the present invention over the prior art lies in the design of seat mount 29, which provides for the use of a plastic as the sole material making up seat mount 29. Thus, unlike the die-cast, metallic prior art swivel seat mounts, the present invention's swivel seat mount is formed entirely of a non-metallic material such as a plastic or plastic composite (e.g. acrylic, nylon or polypropylene with or without fillers such as glass or carbon strands). The present invention thus avoids the significant corrosion problems experienced with prior art swivel seat mounts, which are particularly prevalent in a salt water boating environment, while providing a seat mount with sufficient strength to withstand the rigors associated with a swivel seat mount. This strength is achieved without having to use a substantial amount of plastic material. For example, for a seat mount having the general configuration shown in FIG. 1 (with a height of 85.5 mm, an outer flange side length of about 175 mm, an outer diameter 120 mm at the top outer hole, a diameter of 60 mm for cap reception cavity, and a minimum outer flange radial length of 23.5 mm) the thickness of the seat mount, generally planar upper surface, is preferably 0.20 inches (5.0 mm), the outer wall is preferably 3 mm and the inner wall 34 is preferably 3.5 mm thick. Thus, with a wall thickness of between 2–5 mm, a swivel seat mount formed entirely of plastic is possible under the design of the present invention which meets recommended standards for seating under Section H-31 "Seat Structure of" May 18, 1994, Guidelines of the ABYC. Because seat mount 29 is preferably molded of a single plastic material, it is preferable to slope interior edge 110 of extending flange 36 also at 5° (angle $A_F$).

Reference is now made to FIGS. 1, 2 and 7–17 which illustrate in greater detail pedestal post assembly 24 comprised of end cap 26, air spring assembly 28 and base attachment assembly 30. As particularly shown in FIGS. 7–10, end cap 26 has a generally cylindrical or slightly frusto-conical outer wall 122 with a slight outward slope in going from its upper end 124 to lower end 126. End cap 26 is preferably formed of a die-cast aluminum material further comprising a preferably integrally formed cap cover 128 extending radially inward from outer wall 122. Cap cover 128 includes outer, generally horizontal cover section 130, as well as inwardly positioned upwardly sloping section 132, which extends into second generally horizontal cover section 131 terminating at sloped edge 134. Smooth bends are provided at the intersection of section 130 and 132 and section 132 and 131. Sloping section 132 slopes inwardly at angle A6 which is preferably about 60°, while edge 134 slopes at angle A5 which is preferably about 15°. Radially inwardly extending off from outer wall 122 is at least one protrusion and preferably a plurality of protrusions 136. Protrusions 136 are also preferably integral with the lower region of horizontal cover section 130. Protrusions 136 are integrally formed with outer wall 122 and extend inwardly about the same distance as the intersection of horizontal cover section 130 with upwardly sloped section 132 (e.g., 25% of the average diameter of the end cap reception cavity 138). In a preferred embodiment, there are 6 protrusions 136 equally circumferentially spaced at 60° intervals about the outer wall. Protrusion 136 also preferably converges inward in going from top to bottom to provide wedge shaped members. Free edges 140 of protrusion 136 preferably are parallel with outer wall 122 so as to share a common outer taper of, for example, 1–3°. Alternatively, free edges 140 can independently slope outward in going from top to bottom (e.g., 1–5° taper). Thus, the thicker, most inward portion 151 of projections 152 represent the first contact points of the protrusions 136 with respect to air spring assembly 28, the benefits of which are discussed in greater detail below.

Figure 9:
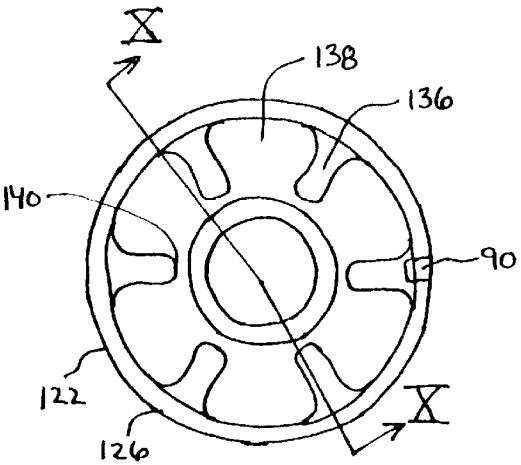
FIG. 9 shows a bottom plan view of the cap in FIG. 8.
Figure 10:
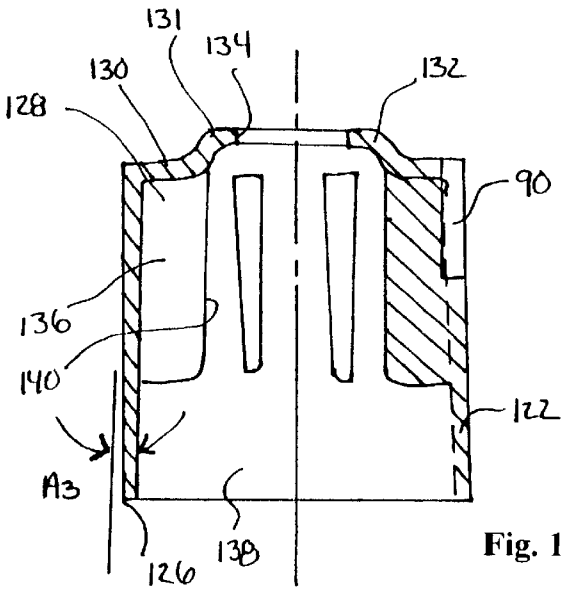
FIG. 10 shows a cross-sectional view of the cap along cross-section line X—X in FIG. 9.
Figure 8:
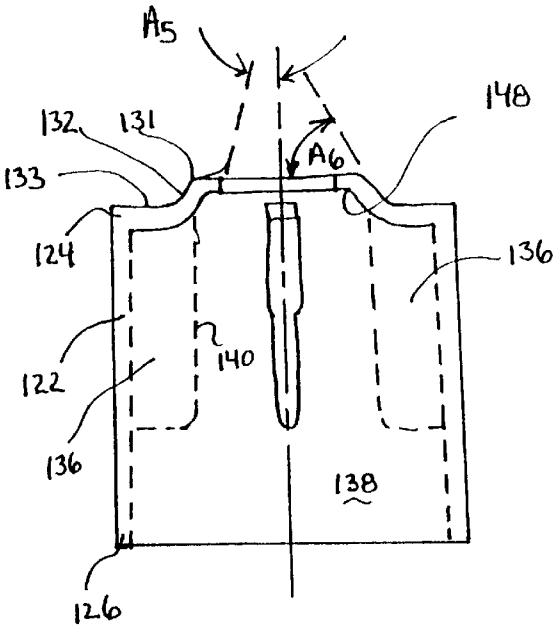
FIG. 8 shows an elevation view of the cap in FIG. 2.

FIGS. 2, 9 and 10 further illustrate the aforementioned cap slot 90 (a recess in this embodiment) which is designed to receive interior insertion component 80 of radial locking block 76. Slot 90 has an open top such that seat mount 29 and its associated insertion component can be axially (vertically in this instance) shifted into and out of a supporting position on end cap 26. In use, the operator's weight will maintain end cap 26 nestled and frictionally retained within end cap reception cavity 32 of seat mount 29 and the end cap is frictionally secured to the inner spring particularly at the compressing contact points 151, although additional axial seat mount locks may also be utilized (e.g., a threaded screw) or inserted pin for the end cap and inner spring end and an annular flange and recess combination for the swivel seat mount and end cap (not shown).

Figure 7:
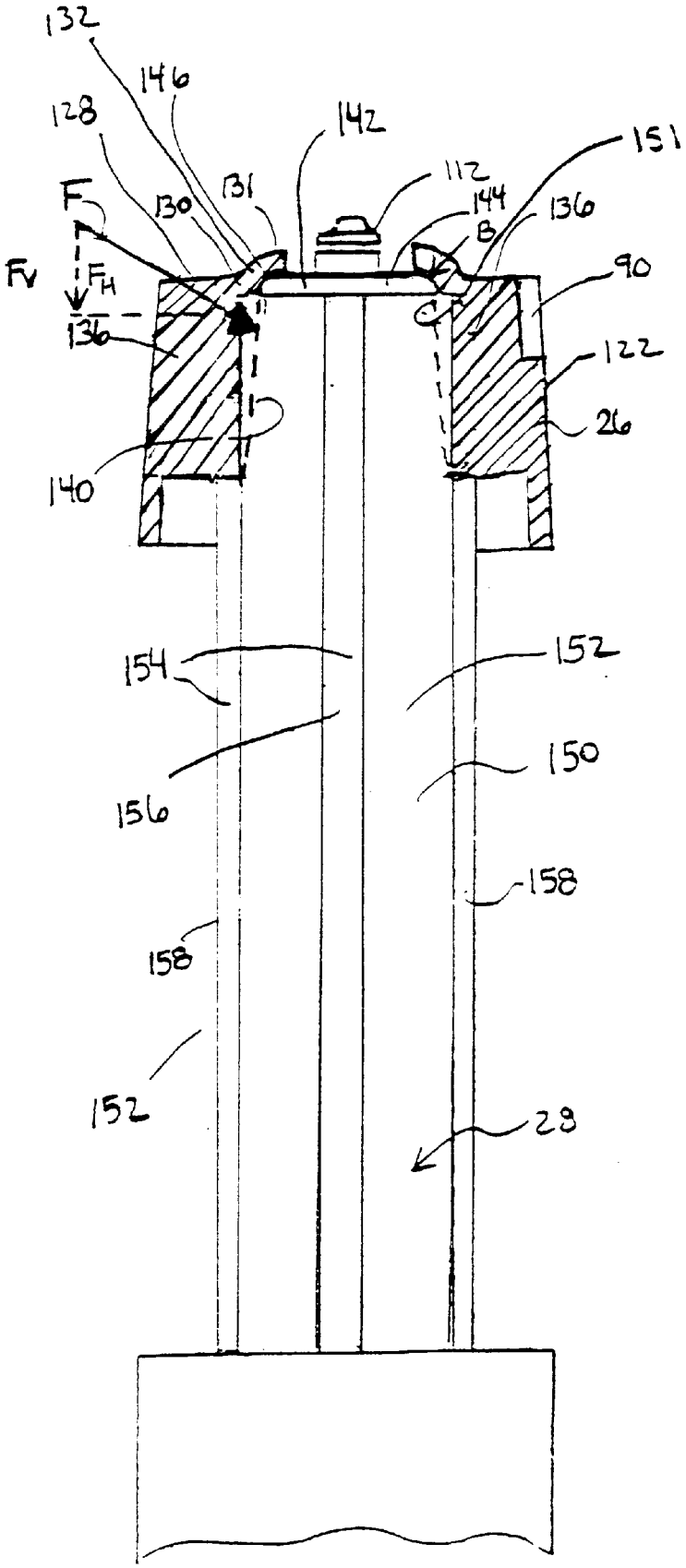
FIG. 7 shows a cut-away view of the top portion of the post assembly shown in FIG. 2 with the top end cap shown in cross-section.

As shown in FIGS. 1, 7 and in 12 air spring assembly 28 includes inner cylinder 142 having top cover 144 through which valve mechanism 112 extends. FIG. 7 also shows curved bearing section 146 of top cover 142 which rests on a correspondingly configured, curved outer edge 148 (FIG. 8) of end cap 26, such that the inner cylinder provides the bearing support with respect to end cap 26 (which in turn supports seat mount 29 and an operator when the seat mount is being used).

Figure 14:
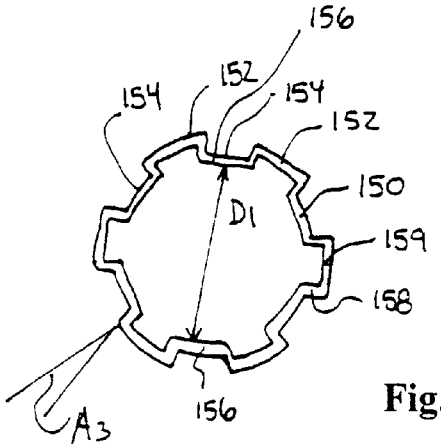
FIG. 14 shows a top plan view of one embodiment of the slotted sleeve rotation prevention member of the present invention.
Figure 15:
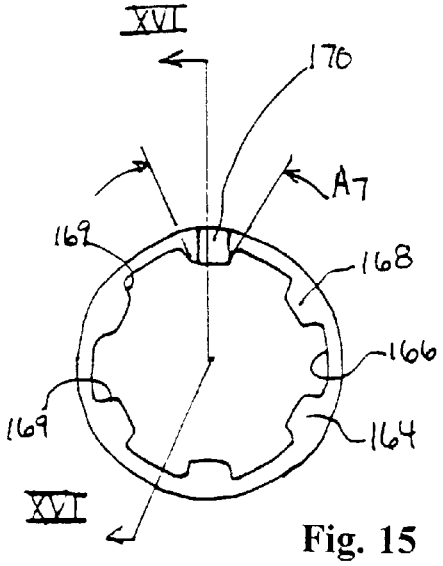
FIG. 15 shows a top plan view of a corresponding slotted rotation locking bushing of the present invention.

FIG. 7 also illustrates the interrelationships between protrusions 136 and rotation prevention member 150. In a preferred embodiment of the invention, rotation prevention member 150 is an outer contoured configuration preferably provided by a sleeve having a repeating sequence of straight side wall projections 152 and recesses 154 about its circumference forming in. An end view of such an embodiment of the rotation prevention member 150 is illustrated in FIG. 14. Preferably, the sleeve is an extruded sleeve such as an extruded aluminum sleeve 150. This extruded sleeve 150 preferably has a minimum interior diameter slightly less than the exterior diameter of main body 141 of inner cylinder 142. For example, a diameter D1 (between recess bases 156 in FIG. 14) which is about $^{20}/_{1000}$'s of an inch less than the exterior diameter D2 (FIG. 13—for main body 141 of inner cylinder 142) such that upon a press fitting of extruded sleeve 150 over main body 141, the two components are sufficiently secured to one another to preclude rotation for all anticipated uses. In a preferred embodiment, rotation prevention sleeve 150 is sufficiently undersized such that when it is stretched over the inner cylinder, it will be able to withstand 150 ft-pounds (205 N·m) of torque without the press fit bond breaking. Additional securement fasteners or the like can, however, be used to supplement the connection or in place of a press fit, although the press fit alone is sufficient to meet the objectives discussed above. The preferred thickness for the extruded sleeve 150 is 0.060 inches (±0.005) or [1.53 mm±0.13] with an outward taper A5 for side walls 158 is preferred with 30° being a suitable pre-press fit orientation. Pairs of side walls extend into external walls 159 as shown in FIG. 14 to form the projections with 4 to 8 preferably 6 projections preferred. The length of extruded sleeve 150 is made sufficient such that a portion of extruded sleeve 150 extends down within the outer air cylinder sleeve 160 (or upper and lower sleeve segments may be used or just one segment with some other locking means at the opposite end). Rotation prevention member 150 provides the function of preventing rotation of end cap 26 with respect to inner cylinder 142. However, as discussed in greater detail below, it also allows for air spring assembly 28 to provide a cushion ride (e.g., for a 1–2 inch compression of air locked in the air spring assembly 28) in that while functioning to prevent rotation, it does not preclude normal, vertical air spring assembly operation. That is, air spring assembly 28 provides a cushion ride and the ability to vertically adjust the height of the seat both when the seat mount is prevented from rotation and when it is free to rotate.

As shown in FIG. 7, the tapered edge 140 of each protrusion 136 results in the thickened upper portion of each protrusion 136 being that portion of each protrusion 136 making contact with extruded sleeve 150, as generally represented by force representation F. The tapered arrangement of protrusions 136 therefore results in end cap 26 applying an inward compressive force $F_H$ against extruded sleeve 150. As weight is placed on end cap 26 and as the vertical force component increases due to added weight on the end cap 26 or other factors such as the dynamics of boat travel, the horizontal force component $F_H$ increases as well to help offset any tendency for separation of the engaged sleeve 150 and inner cylinder 142. In other words, the horizontal force component of Force F acts to press engaged sleeve 150 against the exterior of the main body 141 of the inner cylinder so as to assist in maintaining the press fit or other connection between the two.

The above described press fit arrangement is the most preferred as it allows for use of an off-the-shelf air spring system, which is then modified to provide a new inner air spring embodiment in an economical manner by press fitting an extruded sleeve 150 to the re-built inner cylinder and by adding a rotation prevention bushing between the inner cylinder and outer cylinder. Various other arrangements are also contemplated under the present invention. As a few examples, the inner cylinder 142 can be initially manufactured so as to have one or more recess/projection combinations integral with the main body and which achieve the function of preventing relative rotation while still allowing air spring compression and air spring height adjustment freedom. Alternatively, one and preferably two or more protrusion strips can be adhered to the cylinder or otherwise secured in place to handle the described non-rotation requirement.

Figure 11:
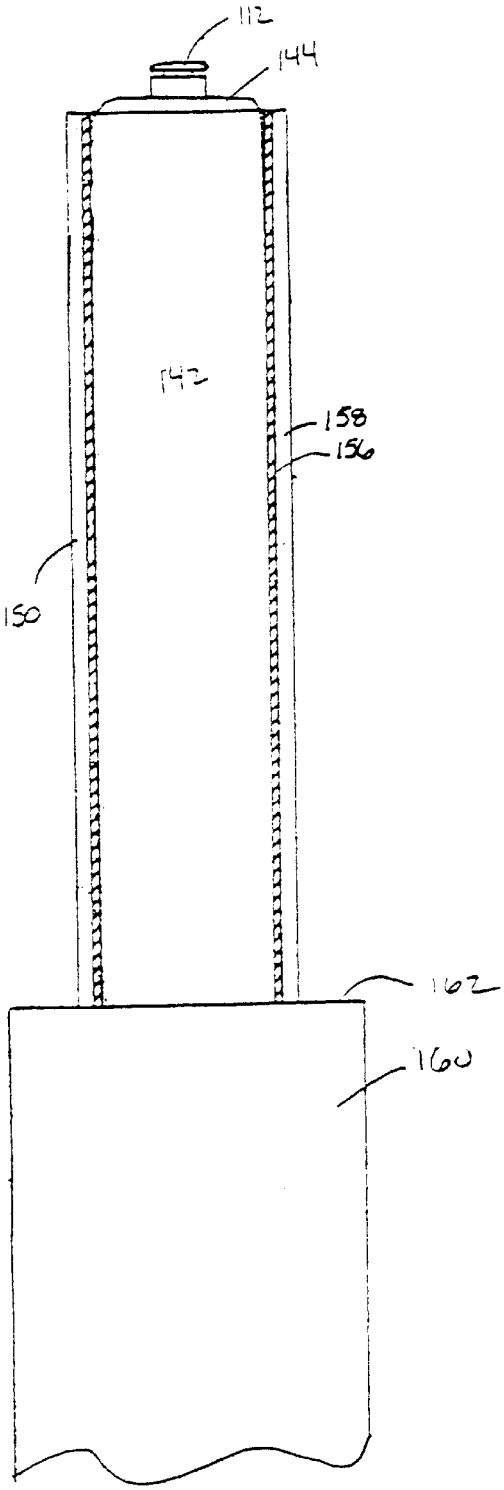
FIG. 11 shows the fluid (air) spring system of the post assembly shown in FIG. 2 with the rotation locking means on the inner cylinder depicted in cross-section.
Figure 12:
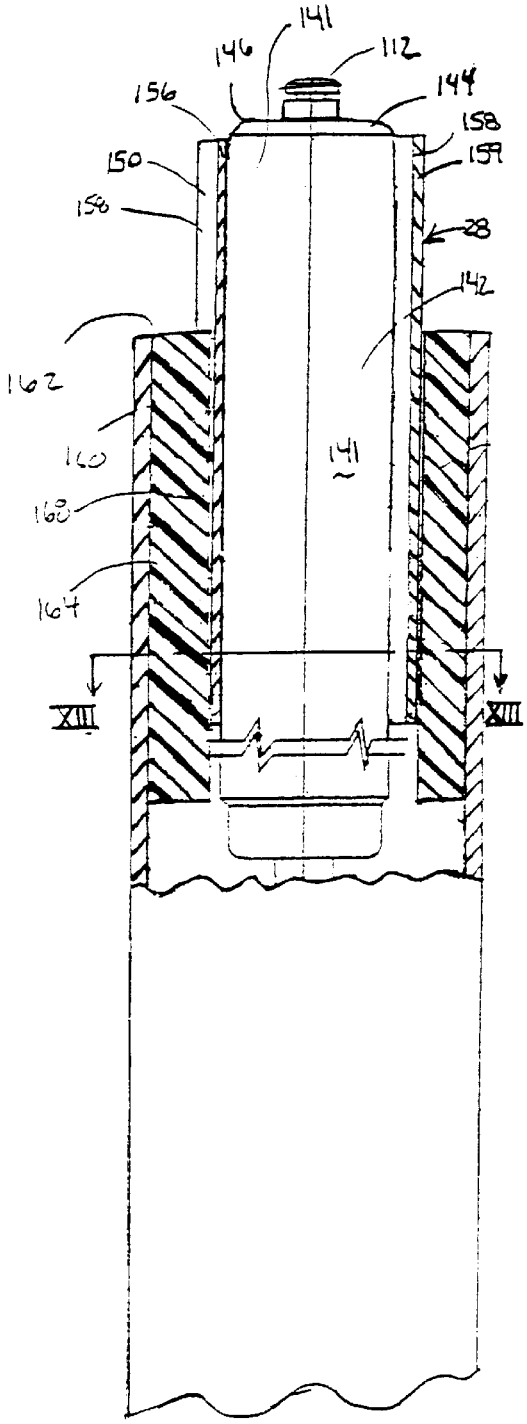
FIG. 12 shows the air spring system of FIG. 11 with a portion of the air spring system cut-away in cross-section to illustrate the rotation locking assembly of the present invention and with the inner cylinder in a lowered position.
Figure 16:
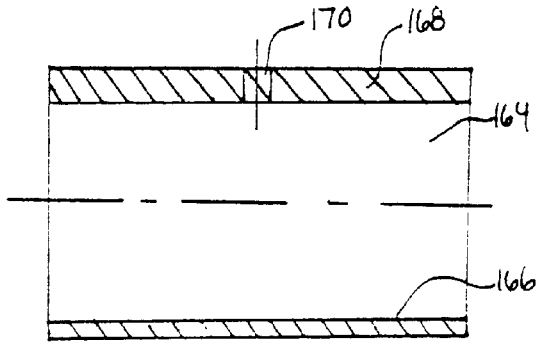
FIG. 16 shows a cross-sectional view of the bushing along cross-section line XVI—XVI in FIG. 15.
Figure 13:
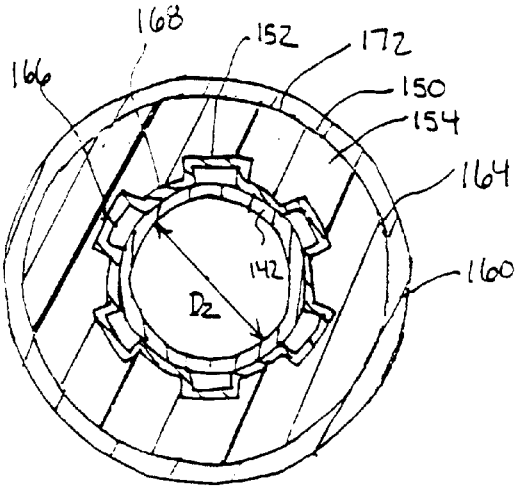
FIG. 13 shows a cross-sectional view of the air spring system taken at the level depicted by cross-section line XIII—XIII in FIG. 12.

FIGS. 2, 11 and 12 illustrate rotation locking member 150 and main body 141 of inner cylinder 142 extending within outer cylinder 160. Outer cylinder 160 is mainly cylindrical in shape with an upper open end 162. As shown in FIGS. 2, 12, and between, for example, at least the upper end of outer cylinder 160 and extruded sleeve 150, there is provided bushing 164. Bushing 164 is shown by itself in FIGS. 15 and 16. Bushing 164 includes a repeating series of grooves 166 and ridges 168 about its circumference with grooves 166 receiving projections 152 and elongated ridges 168 extending into recesses 154 of rotation locking sleeve 150 both in a tight fit, axial sliding ability relationship (see FIG. 13). FIG. 16 illustrates that bushing 164 has a generally cylindrical shape with its interior having varying thicknesses in conformance with the groove/ridge sequence with the grooves and ridges extending the full axial length of bushing 164. Side walls 169 which partially define grooves 166 are sloped at angle A7 which preferably conforms to the formula A7=AS such that when angle A7 is at a 30° angle, AS is 30°. This arrangement provides a degree of dovetail interlocking as illustrated in FIG. 13. Bushing 164 is preferably formed of a low friction plastic material. Aperture 170 is positioned about half way between the ends of bushing 64 in one of ridges 164.

FIGS. 12 and 13 further show bushing 164 filling entirely the space 10 between interior wall 172 of outer cylinder 160 and extruded sleeve 150. FIG. 2 shows one of three pairs of pin fasteners 174. The pairs of pin fasteners are spaced 120° apart such that the second and third sets of pin fasteners are not visible in FIG. 2. Pin fasteners secure bushing 164 to outer cylinder 160 so as to prevent rotation of bushing 164 with respect to the cylinder for at least 150 ft-lbs (205 N·m) torque.

Extruded sleeve 150 is physically held from rotating by bushing 164 but is free to shift vertically in accordance with the cushion ride and vertical adjustment capabilities of air spring assembly 128. Thus, the interrelationship between bushing 164 and extruded sleeve 150 provides for a strong rotation prevention arrangement, while not disrupting vertical adjustments which occur during air spring operations, which can include a valve closed air compression/cushioning adjustment or a valve opened height adjustment.

Figure 17:
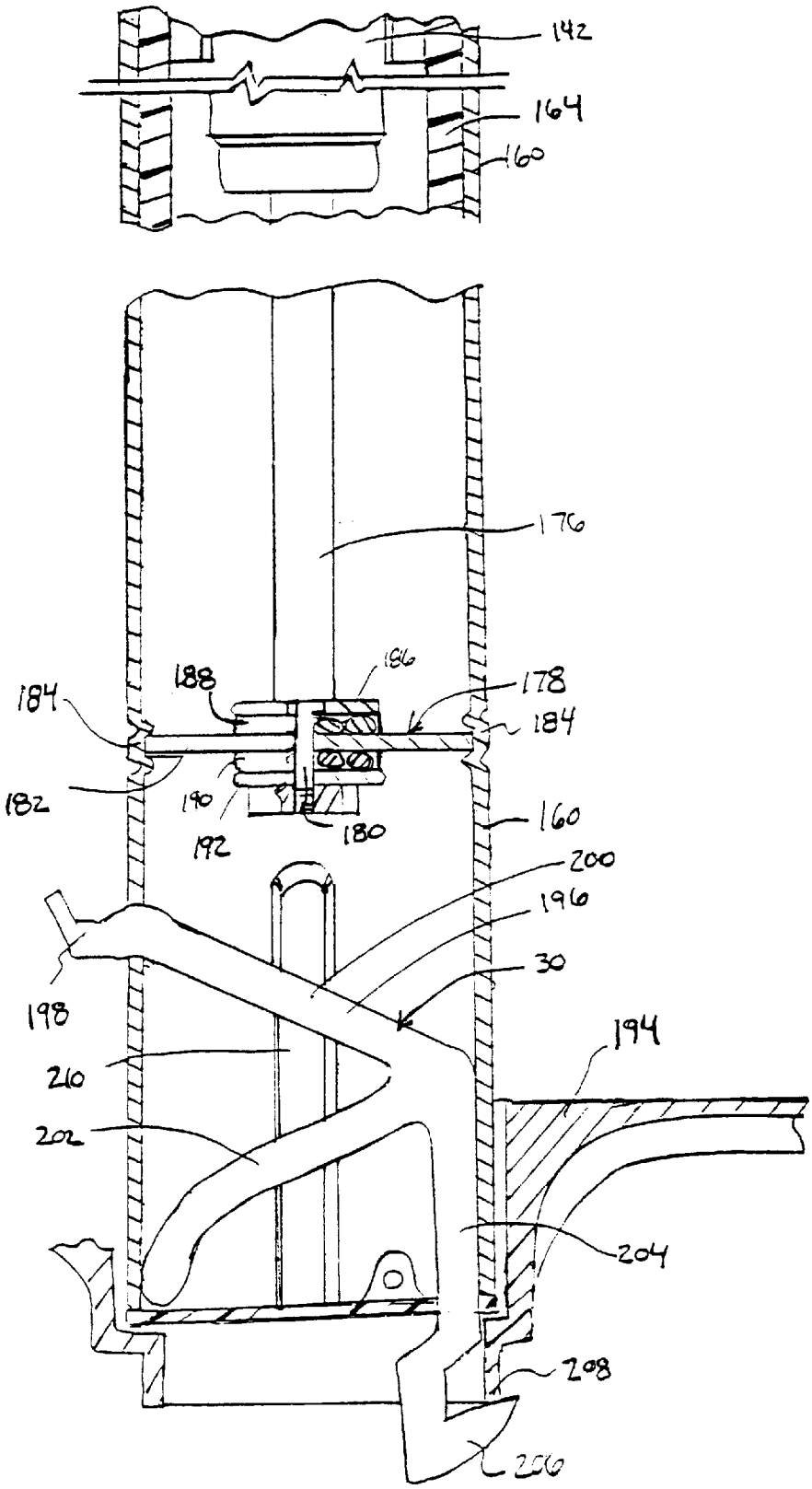
FIG. 17 shows a cross-sectional, cut-away view of the bottom of the air spring assembly shown in FIG. 2.

FIGS. 2, 12 and 17 illustrate the "Power Rise"™ air spring system which is particularly advantageous for use in the present invention, as well as the Spring-Lock™ system which provides an easy engagement and release of a pedestal post/base combination. These two systems are illustrated and described in The Springfield Marine Company of Nixa, Mo. Product Catalogues of 1995 and 1996, which are incorporated herein by reference in their entirety. The Power Rise™ system features an air spring system that allows an operator to lower the relative position of a supported seat with respect to a lower cylinder by applying weight to the seat when the valve mechanism is opened through use of a handle mechanism. Once in a desired position, the release of the handle results in the seat maintaining the desired height. If an upward height adjustment is desired, then the operator need only trigger the handle without applying the operator's weight to the seat whereupon the air spring utilizes the compressed air pocket (which provides the air cushion ride as well) to automatically lift the seat to the desired height, whereupon the handle is released to lock the seat in position. While the Power Rise™ system is particularly suited for use in the arrangement of the present invention, different fluid or non-fluid vertical adjustment seat pedestal arrangements would also be well suited for use under the present invention in that the arrangement of the present invention provides means for a rotation locking and unlocking, while simultaneously still allowing for vertical adjustments in the support pedestal, if so desired. Also, while the ability of the present invention to prevent rotation while still allowing for vertical adjustment makes the rotation locking assembly of the present invention particularly useful in a vertically adjusting seat pedestal environment, it also provides an easily manipulated and secure rotation prevention locking arrangement for use with non-vertically adjusting seat pedestals. Also, while the below described Spring-Lock™ pedestal/base securement system is well suited for use in the present invention a variety of other pedestal post/base securement means can also be utilized with the present invention, such as the "Taper-Lock"™ pedestal post/base securement system also described in the aforementioned product catalogues of Springfield Marine Company.

To further illustrate the operation of the present invention, a cut-out view of the bottom of the Power Rise™ system is shown in FIG. 17. As shown in FIG. 17, inner cylinder 142 receives piston shaft 176 in a sealed fashion. Piston shaft 176 is fixed from vertical movement by shaft connection assembly 178. Through manipulation of valve 112, inner cylinder 142 shifts in vertical position with respect to shaft 176. Piston shaft 176 has threaded shaft extension 180 which is received by shaft connection assembly 178. Shaft connection assembly 178 includes circular platform 182 which is retained within the interior of outer cylinder at a location between fastener pins 174 and base attachment assembly 30. Circular platform 182 is prevented from vertically shifting within cylinder 160 by way of indentation pairs 184 which extend above and below the platform to fix circular platform 182 at a desired height level and also preferably limit free rotation of platform 182 by way of frictional contact. In a preferred embodiment, there are four indentation pairs spaced 90° apart about the circumference of outer cylinder 160.

Stacked along shaft extension 180 are upper washer 186, upper bearing housing assembly 188, lower bearing housing 190, lower washer 192, and threaded nut 193, which is engaged with the threaded tip of extension 180. Such shaft connection assemblies are present in conventional air spring systems to provide for relative rotation between the inner cylinder (with attached seat) and outer cylinder. Thus, under the conventional air spring systems this freedom to rotate prevented the use of an air-spring system in the driver's location of a boat in accordance with the ABYC Guidelines discussed above. Of course any attempt to provide a rotation locking mechanism at the juncture between the interior, telescoping cylinder above the other cylinder would result in the loss of vertical adjustment capability between the two telescoping components.

The present invention's design, however, provides a rotation location at an upper end of the pedestal (i.e., the end cap in the preferred embodiment), with an on/off rotation locking assembly at the upper end of the pedestal and (preferably permanent) rotation prevention means at the junction of the two telescoping components, as well as (as will be explained in greater detail below) at the pedestal post/base level. As the present invention features means for preventing rotation (while still allowing for telescoping adjustment) between the inner and outer cylinders, the bearing assemblies 188 and 190 shown in FIG. 17 are not necessary but also do not detract from the function of the present invention's arrangement such that conventional off-the-shelf shaft and inner cylinder/outer cylinder combinations with rotation capability can be utilized in the present invention.

FIG. 17 further illustrates base attachment assembly 30 received within base 194 (shown in cross-section and cutaway in FIG. 17). Base attachment assembly 30 is preferably in the form of the Spring-Lock™ pedestal post and base system sold by Springfield Marine Company of Nixa, Mo., which includes a unitary plastic body 196 having push button activator 198, first leg 200, intermediate leg 202, and vertical leg 204, having latch 206 formed at its lower, free end. In its normal state, both push button activator 198 and latch 206 extend outward. Upon depressing push button activator 198, latch 206 shifts inward so as to release latch 206 from its normal latched engagement with the bottom rim of base 194.

FIGS. 2 and 17 further illustrate rotation stop mechanism 210 of the present invention formed in the lower end of outer cylinder sleeve 160. In the embodiment shown in FIGS. 2 and 17, rotation stop mechanism is comprised of a vertically extending, elongated depression formed in a lower end of sleeve 160. Depression 210 is shown as being an inwardly extending depression extending into base 194 when latch 206 is engaged. Depression 210 is designed to receive a corresponding protrusion formed in base 194 (not shown) which protrudes into depression 210 when the lower end of sleeve 160 is set in place. Depression 210 can be formed in any conventional manner such as by deforming a cylindrical sleeve such as sleeve 160. The protrusion formed in base 194 can either be an integral component of base 194 or a fixed bushing with its own projection. Alternatively, rather than a depression in sleeve 160 an elongated projection can be provided which is received in a corresponding depression formed in base 194. (See also co-pending application Ser. No. 08/614,144, filed on Mar. 12, 1996.) Various other rotation stop mechanisms can also be relied upon which achieve the desired function of precluding rotation of sleeve 160 with respect to a fixed in position base while preferably also allowing for relatively easy insertion of the sleeve into the supporting base. The rotation stop mechanism also preferably is strong enough to withstand 150 ft-lbs of torque (205 N·m) in accordance with the ABYC guidelines.

FIG. 17 further illustrates cap plug 207 secure to the bottom end of sleeve 160 and having a periphery which conforms to the depressions formed in the end of the sleeve so as not to disrupt easy insertion.

Figure 18:
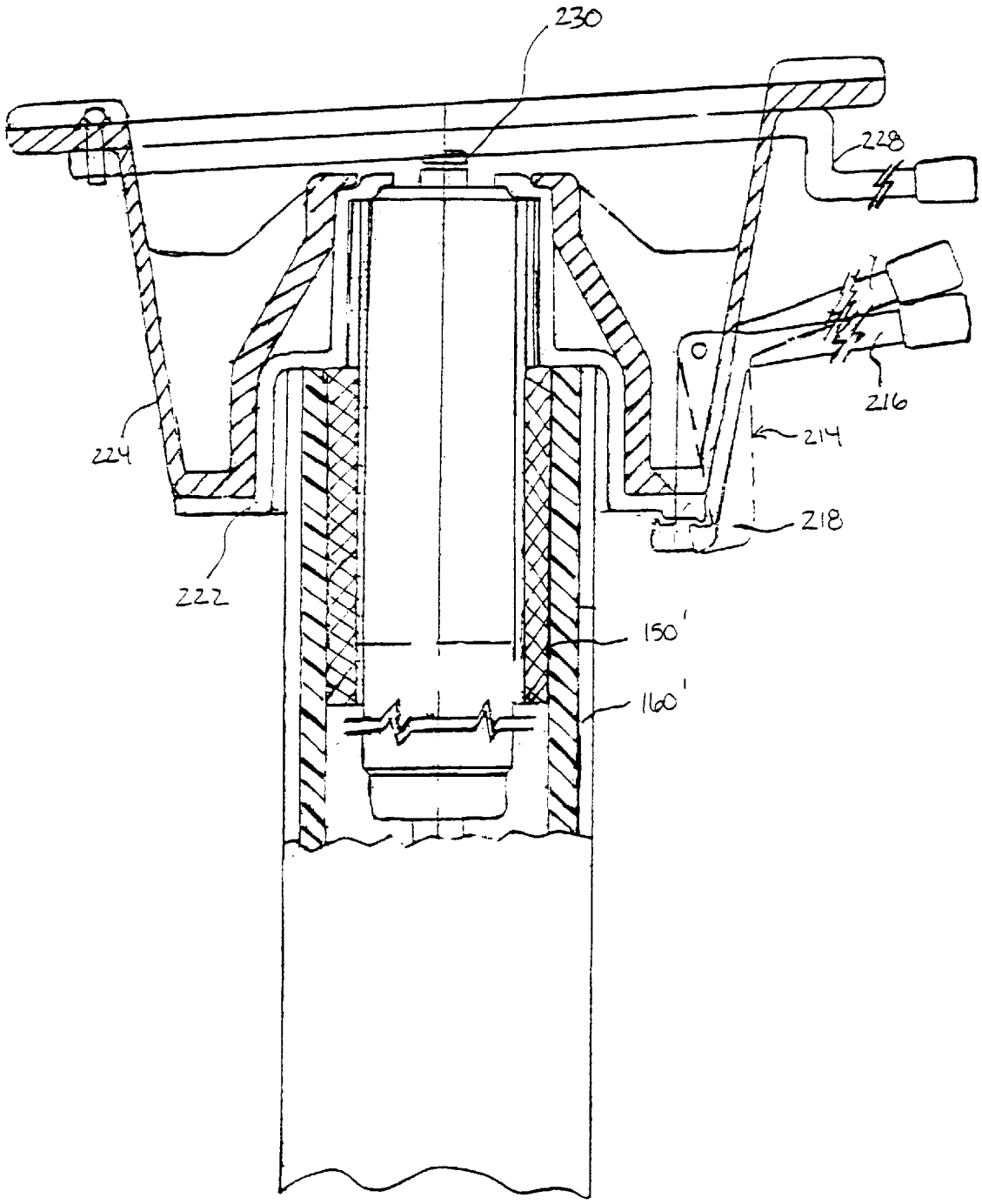
FIG. 18 shows a cross-sectional view of an alternate embodiment of the present invention.

FIG. 18 illustrates an alternate embodiment of the present invention which features a modified rotation locking assembly 214 having a vertically pivoting handle member 216 with lower latch 218 which is received within slot 220 formed in a bottom, peripheral surface of end cap 222. End cap 222 is fixed from rotation with a projection/recess sleeve engagement. Molded plastic seat mount 224 rests on end cap 222 such that it can freely pivot upon latch 218 being disengaged. Lever 228 is similar to lever 38 except that it can be shifted along a slightly downward tapered, generally horizontal slot to trigger valve 230.

As another example of some possible variations, the rotation prevention stop mechanism provided at the end of the sleeve 160 for preventing rotation with respect to the base, can also take on the form of a Taper-Lock™ pedestal post in base system such as that described in the aforementioned Springfield Marine Company Product Brochures or an improved version thereof better suited for handling torques in excess of 150 ft-lbs (205 N·m) such as that described in co-pending application Ser. No. 08/672,364 sharing at least one common inventor.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A seat assembly, comprising:

a seat mount;

a pedestal post assembly which pivotally supports said seat mount and includes a first component and a second component with the second component being adjustable in height with respect to the first component;

a rotation locking assembly which includes a releasable rotation lock which locks said seat mount from rotating with respect to said pedestal post assembly; and a rotation prevention device which is supported by said pedestal post assembly so as to prevent relative rotation between said first and second components while not interfering with height adjustability between said first and second components, wherein said pedestal post assembly includes a fluid spring system which includes said first and second components with at least one of said components being variable in height due to a fluid cushion formed by said fluid spring system, wherein said first component is one of a fluid spring inner member and fluid spring outer cylinder and said second component is a remaining one of said fluid spring inner member and said fluid spring outer cylinder, and said first component is the outer cylinder and said second component is a fluid spring inner member telescopically received by said outer cylinder.

2. A seat assembly as recited in claim 1, wherein said rotation prevention device includes at least one elongated projection extending along at least one of said inner cylinder and outer cylinder.

3. A seat assembly as recited in claim 2 wherein said inner cylinder includes a plurality of externally positioned, elongated projections spaced about said inner cylinder so as to define a plurality of grooves between said projections, and said rotation prevention device further comprising a series of ridges and grooves supported by said outer cylinder and in engagement with said projections and grooves of said inner cylinder to prevent relative rotation between said inner and outer cylinders.

4. A seat assembly as recited in claim 3 wherein said ridges and grooves supported by said outer cylinder are formed in a bushing member secured to said outer cylinder.

5. A seat assembly as recited in claim 3 wherein said elongated projections and grooves of said inner cylinder are defined by an extruded sleeve which is in non-rotation engagement with an outer surface of a main body of said inner cylinder.

6. A seat assembly as recited in claim 3 wherein said pedestal post assembly further comprises an end cap pivotally supported on an upper end of said inner cylinder, said end cap having means for engaging with said releasable rotation lock of said rotation locking assembly so as to prevent rotation of said seat mount with respect to said end cap, and said end cap including at least one protrusion which is receivable within one of said grooves formed between the projections of the inner cylinder so as to prevent relative rotation between said end cap and inner cylinder.

7. A seat assembly as recited in claim 6 wherein said end cap includes a plurality of circumferentially spaced protrusions at least one of which has an inner edge that slopes outward in going from a top area of said cap to a more lower region of said end cap.

8. A seat assembly as recited in claim 1 wherein said pedestal post assembly includes an end cap which is positioned on said second component and received within a recess formed in said seat mount such that said seat mount is free to rotate with respect to said end cap when said releasable rotation locking assembly is in a non-locking state, said end cap having means for engaging with said releasable rotation lock and means for engaging with said second component in a non-rotation fashion.

9. A seat assembly as recited in claim 8 wherein said first component is an outer air spring cylinder and said second component is an inner air spring cylinder which is telescopically received within said outer cylinder.

10. A seat assembly as recited in claim 8 wherein said pedestal post assembly further comprises a base attachment assembly positioned on an end of said pedestal post assembly opposite to said end cap, and said pedestal post assembly having means for preventing rotation of said pedestal post assembly with respect to a base to which said base attachment assembly is attached.

11. A seat assembly as recited in claim 8 wherein said second component is an inner air spring cylinder and said inner air spring cylinder has a height adjustment mechanism and said seat mount assembly includes means for triggering said height adjustment assembly.

12. A seat assembly as recited in claim 11 wherein said means for triggering includes a first operator contact device and said releasable rotation locking assembly includes a second operator contact device supported by said seat mount assembly, and said first and second operator contact devices both extend out from a common side of said seat mount within less than 60° from each other and said common side representing a front section of said seat mount when in seat support position.

13. A seat assembly as recited in claim 12 wherein said seat mount has an interior wall defining a reception cavity which represents said recess for receiving said end cap and an outer wall extending away from a common, lower connection with said inner wall in an outwardly oblique fashion so as to define an annular cavity between said inner and outer walls, and said rotation locking assembly including a block of material representing said releasable rotation lock and having an extension insertable through a hole in said inner wall for contact with said engaging means of said end cap, a biasing member for biasing said block into a locking state and a handle representing said second operator contact device which extends through an opening formed in said outer wall.

14. A seat assembly as recited in claim 1 wherein said seat mount is entirely formed of plastic.

15. A seat assembly as recited in claim 1, further comprising a seat unit.

16. A seat assembly, comprising:

a pedestal post assembly having an upper section and a lower section, and means for providing a relative adjustment in height between an upper end of said upper section and said lower section;

a seat mount which is pivotally supported on the upper section of said pedestal post assembly;

a locking mechanism for releasably attaching, in non-rotation fashion, said seat mount on said upper section;

means for precluding rotation of said upper section and said lower section while not interfering in the freedom of relative height changes between said upper end of said upper section and said lower section, wherein said upper section includes a first fluid spring system unit and said lower section includes a second fluid spring system unit and said means for providing a relative adjustment in height includes a compressible fluid cushion formed between said first and second fluid spring units; and, wherein said means for precluding rotation includes a plurality of elongated interlocking projections and grooves provided between said first and second fluid spring system units.

17. A seat assembly as recited in claim 16 further comprising base attachment means provided at a lower end of said lower section for attachment with a base member so as to preclude rotation of said lower section with respect to said base member.

18. A method of forming a seat assembly comprising:

providing a seat mount;

providing a pedestal post assembly, that has a first end that pivotally supports said seat mount when combined and which has first and second height adjustment components;

providing a releasable rotation locking member used for locking said seat mount from rotating with respect to said pedestal post assembly; and providing rotation precluding member means for precluding rotation of said first and second height adjustment components while allowing free vertical adjustment therebetween; and said method further comprising press fitting a sleeve with projections and grooves over one of said first and second height adjustment components to form at least a portion of said rotation precluding means.

* * * * *